US011700976B1

(12) United States Patent
Yang

(10) Patent No.: US 11,700,976 B1
(45) Date of Patent: Jul. 18, 2023

(54) BABY BATH CHAIR

(71) Applicant: Shenzhen Zhitong Innovation Technology Co., Ltd., Shenzhen (CN)

(72) Inventor: Jianbo Yang, Zhangzhou (CN)

( * ) Notice: Subject to any disclaimer, the term of this patent is extended or adjusted under 35 U.S.C. 154(b) by 0 days.

(21) Appl. No.: 18/088,721

(22) Filed: Dec. 26, 2022

(30) Foreign Application Priority Data

Jan. 12, 2022 (CN) ..... 202220071131.9

(51) Int. Cl.
*A47K 3/28* (2006.01)
*A47D 1/00* (2006.01)

(52) U.S. Cl.
CPC ..... *A47K 3/282* (2013.01); *A47D 1/008* (2013.01)

(58) Field of Classification Search
CPC ..... A47K 3/282; A47D 1/008
USPC ..... 4/578.1
See application file for complete search history.

(56) References Cited

U.S. PATENT DOCUMENTS 2,802,444 A * 8/1957 Gilmour ..... A47K 11/04 84/95.2
5,359,737 A * 11/1994 Hodge ..... A47K 11/04 4/476
5,991,938 A * 11/1999 Bonior ..... A47K 11/04 4/483
11,147,391 B2 10/2021 Terhune et al.
11,197,587 B2 12/2021 Fusco et al.
11,330,941 B1 5/2022 Tottenham
2016/0029812 A1 2/2016 Terhune et al.
2019/0174966 A1 6/2019 Murphy

FOREIGN PATENT DOCUMENTS

CN 209018215 U 6/2019
CN 215604502 U 1/2022
CN 216797477 U 6/2022

* cited by examiner

*Primary Examiner* — Huyen D Le

(57) ABSTRACT

The present invention discloses a baby bath chair, including a seat, a backrest, and a dish tray. The backrest is hinged with a back end of the seat. The backrest can be adjustably rotated in multiple stages forwards and rearwards. A left-side middle portion and a right-side middle portion of the seat are formed with a left convex portion and a right convex portion, respectively. A back end of the dish tray is formed backward with a left connecting portion and a right connecting portion. The left connecting portion and the right connecting portion are detachably connected to the left convex portion and the right convex portion, respectively. The left connecting portion and the right connecting portion can be rotated around the left convex portion and the right convex portion, respectively. A top surface of the seat is provided with a drainage hole. The present invention can be used as a bath chair or as a dining chair. The backrest can be adjusted in multiple stages to adapt to different dining spaces or bathing angles of a baby. The dish tray can be rotated around the left convex portion or the right convex portion. When the baby needs to enter the seat, the dish tray can be rotated around the left convex portion or the right convex portion, so that the baby can enter the seat from a front side of the seat conveniently.

12 Claims, 8 Drawing Sheets

BABY BATH CHAIR

TECHNICAL FIELD

The present invention relates to the field of a baby article, and in particular, to a baby bath chair.

BACKGROUND

Learning to bathe a baby is definitely a special and challenging task for new parents. The new parents should always hold their baby in their arms and never leave their baby in their sight. Therefore, the new parents can use a baby bath chair when bathing their baby in a bathtub. A structure and functions of a baby bath chair in the prior art on a market are relatively simple, and generally only used for a baby to take a bath while sitting. A functional design of a baby bath chair in the prior art is not user-friendly, such as not being able to meet need of a change of a bathing posture, and inconvenience for the baby to enter and exit the bath chair, etc. Based on this, the applicant, after intensive research, has produced this solution.

SUMMARY

A main objective of the present invention is to propose a baby bath chair, which overcomes a problem that a function of a baby bath chair in the prior art is simple.

To achieve the above objective, the baby bath chair according to the present invention includes a seat, a backrest, and a dish tray. The backrest is hinged with a back end of the seat. The backrest can be adjustably rotated in multiple stages forwards and rearwards. A left-side middle portion and a right-side middle portion of the seat are formed with a left convex portion and a right convex portion, respectively. A back end of the dish tray is formed with a left connecting portion and a right connecting portion. The left connecting portion and the right connecting portion are detachably connected to the left convex portion and the right convex portion, respectively. The left connecting portion and the right connecting portion can be rotated around the left convex portion and the right convex portion, respectively. Atop surface of the seat is provided with a drainage hole.

Further, a back portion of the seat is provided with a left hinged plate and a right hinged plate. A bottom left end and a bottom right end of the backrest are hinged with the left hinged plate and the right hinged plate, respectively. The left hinged plate is provided with a plurality of adjacent and circularly arranged left receptacles. The right hinged plate is provided with a plurality of adjacent and circularly arranged right receptacles. The backrest is provided therein with a left inserting rod and a right inserting rod, and a pulling member that pulls the left inserting rod and the right inserting rod to move. A back end surface of the pulling member is provided with a pulling portion. A back end surface of the backrest is provided with a hand placement groove. The pulling portion is positioned in the hand placement groove.

Further, the pulling member includes a pulling plate, a left pulling rod, a right pulling rod, a left-inserting rod connecting portion, and a right-inserting rod connecting portion. A top end of the left pulling rod and a top end of the right pulling rod are connected to a bottom portion of the pulling plate. A bottom end of the left pulling rod and a bottom end of the right pulling rod are connected to a right end of the left-inserting rod connecting portion and a left end of the right-inserting rod connecting portion, respectively. The left pulling rod and the right pulling rod are arranged in a shape of Chinese character "Ba" at a back portion of the seat. A left end of the left-inserting rod connecting portion is connected to a right end of the left inserting rod. A right end of the right-inserting rod connecting portion is connected to a left end of the right inserting rod. A left end of the left inserting rod is inserted into the left receptacle by passing through the bottom left end of the backrest. A right end of the right inserting rod is inserted into the right receptacle by passing through a bottom right end of the backrest. The pulling portion is arranged on a back end surface of the pulling plate.

Further, the backrest is provided with a pulling plate groove, a left-pulling rod groove, a right-pulling rod groove, a left movable groove, and a right movable groove that are mutually connected. The pulling plate is positioned in the pulling plate groove. The pulling plate has a height smaller than that of the pulling plate groove. The pulling plate is provided with two strip-shaped grooves arranged above and below. The pulling plate is limited in the pulling plate groove by passing through the two strip-shaped grooves via two screws with gaskets. The left pulling rod and the right pulling rod are positioned in the left-pulling rod groove and the right-pulling rod groove, respectively. The left-inserting rod connecting portion and the right-inserting rod connecting portion are positioned in the left movable groove and the right movable groove, respectively. The left-inserting rod connection portion has a length smaller than that of the left movable groove. The right-inserting rod connection portion has a length smaller than that of the right movable groove. The left-inserting rod connecting portion and the right-inserting rod connecting portion are provided with a left strip-shaped groove and a right strip-shaped groove. The left-inserting rod connecting portion is limited in the left movable groove by passing through the left strip-shaped groove via a left screw with a gasket. The right-inserting rod connecting portion is limited in the right movable groove by passing through the right strip-shaped groove via a right screw with a gasket. The left-inserting rod connecting portion is provided therein with a left spring that abuts against the left screw. The right-inserting rod connecting portion is provided therein with a right spring that abuts against the right screw.

Further, the left hinged plate is provided with a left folding receptacle. The left folding receptacle is positioned on a front side of the left receptacle and can be inserted by the left inserting rod. The right hinged plate is provided with a right folding receptacle. The right folding receptacle is positioned on a front side of the right receptacle and can be inserted by the right inserting rod.

Further, the left convex portion and the right convex portion are provided with a left hinged groove and a right hinged groove, respectively. A left end surface of the left hinged groove and a right end surface of the right hinged groove are both open structures. The left hinged groove is provided with a left hinged portion hinged therewith. The right hinged groove is provided with a right hinged portion hinged therewith. A bottom portion of the left connecting portion is provided with a left slot. A bottom portion of the right connecting portion is provided with a right slot. An upper portion of the left hinged portion is positioned in the left slot. An upper portion of the right hinged portion is positioned in the right slot. A bottom left side of the left connecting portion is provided with a resilient left side plate. The left side plate is provided with a left sticking hole. A left side surface of the left hinged portion is provided with a left sticking portion that is clipped into the left sticking hole. A bottom right side of the right connecting portion is provided with a resilient right side plate. The right side plate is provided with a right sticking hole. A right side surface of the right hinged portion is provided with a right sticking portion that is clipped into the right sticking hole. Movable gaps are provided between a bottom surface of the left hinged portion and an inner bottom surface of the left hinged groove, and between a bottom surface of the right hinged portion and an inner bottom surface of the right hinged groove.

Further, outer wall surfaces of the left side plate and the right side plate are provided with reinforcing ribs.

Further, the back end surface of the backrest is provided with two towel hooks.

Further, the baby bath chair further includes a fixing assembly arranged at the front end of the seat. The fixing assembly includes a suction tray, a hinged rod, an unlocking handle, and a resetting spring. The front end of the seat is provided with a fixing groove. A bottom portion of the fixing groove is opened and provided with a through hole. The hinged rod is connected to the suction tray by passing through the through hole. The unlocking handle is arranged in the fixing groove and hinged with the hinged rod. The resetting spring is sleeved on the hinged rod, and two ends thereof abut against the suction tray and an interior wall of the seat, respectively.

Further, the back end of the seat is provided with a portable groove.

Further, a bottom portion of the seat is provided with the plurality of suction trays Further, the top surface of the seat is provided with a slide-proof pad, and a plurality of slide-proof strips are provided on the slide-proof pad.

From the above description of the present invention, compared with the prior art, the present invention has the following advantages: the present invention can be used as a bath chair or as a dining chair. The backrest can be adjusted in multiple stages to adapt to different dining spaces or bathing angles of a baby.

The dish tray can be rotated around the left convex portion or the right convex portion. When the baby needs to enter the seat, the dish tray can be rotated around the left convex portion or the right convex portion, so that the baby can enter the seat from a front side of the seat conveniently. The present invention is more functional and has a more user-friendly design.

BRIEF DESCRIPTION OF THE DRAWINGS

To explain embodiments of the present invention or the technical solutions in the prior art more clearly, the following briefly introduces the drawings that need to be used in the embodiments or the prior art. Obviously, the drawings in the following description are only some of embodiments of the present invention.

Those skilled in the art may obtain other drawings based on structures shown in these drawings without creative labor.

DESCRIPTION OF THE INVENTION

Figure 1:
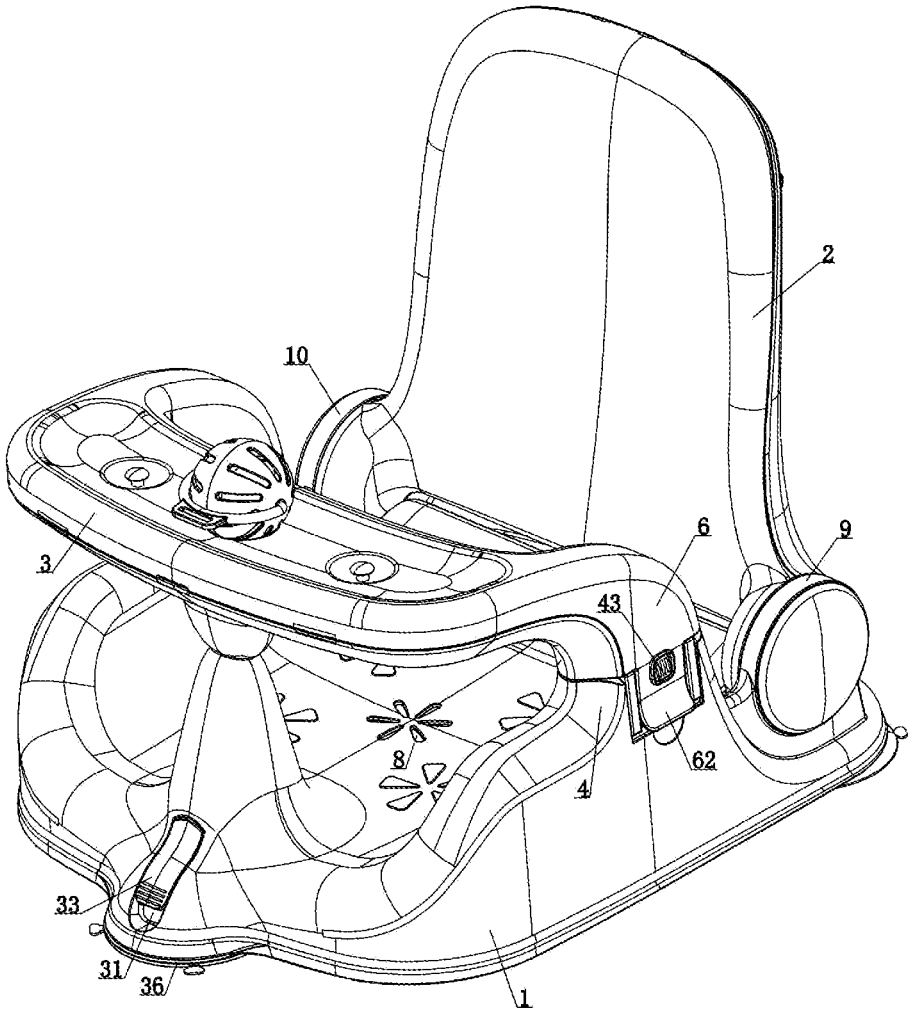
FIG. 1 is a schematic structural diagram of an embodiment of the present invention.

The following clearly and completely describes the technical solutions in the embodiments of the present invention in conjunction with the drawings in the embodiments of the present invention. Obviously, the described embodiments are only a part of the embodiments of the present invention, rather than all embodiments. All other embodiments obtained by those skilled in the art based on the embodiments of the present invention without creative labor shall fall within the protection scope of the present invention.

It should be noted that if the embodiments of the present invention involve directional indications (such as up, down, left, right, front, back . . . ), the directional indications are only used to explain a relative position relationship and movement among various components under a certain posture (as shown in the drawings). If a specific posture changes, the directional indications also change accordingly.

In addition, if there are descriptions of terms such as "first", "second" and the like in the embodiments of the present invention, the descriptions of the terms such as "first", "second" and the like are merely intended for a purpose of description, and shall not be understood as an indication or implication of relative importance or implicit indication of a quantity of indicated technical features. Therefore, the features defined with "first" and "second" may explicitly or implicitly include at least one of the features. In addition, the meaning of "and/or" in the whole text is to include three parallel schemes. Taking "A and/or B" as an example, "A and/or B" includes scheme A, scheme B, or a scheme that A and B are satisfied at the same time. In addition, the technical solutions between the various embodiments can be combined with each other, but should be based on what can be achieved by those skilled in the art. When a combination of technical solutions is contradictory or cannot be achieved, it should be considered that such a combination of technical solutions does not exist, and also does not fall within the scope of protection required by the present invention.

The present invention relates to a baby bath chair.

Referring to FIGS. 1 to 7, a baby bath chair includes a seat 1, a backrest 2, and a dish tray 3. The backrest 2 is hinged with a back end of the seat 1 such that the backrest 2 can be adjustably rotated in multiple stages forwards or backwards relative to the back end of the seat 1. A left-side middle portion and a right-side middle portion of the seat 1 are formed with a left convex portion 4 and a right convex portion 5, respectively. A back end of the dish tray 3 is bent downwards to form a left connecting portion 6 and a right connecting portion 7. The left connecting portion 6 and the right connecting portion 7 are detachably connected to the left convex portion 4 and the right convex portion 5, respectively. The left connecting portion 6 and the right connecting portion 7 can be rotated about the left convex portion 4 and the right convex portion 5, respectively. A top surface of the seat 1 is provided with a drainage hole 8.

Referring to FIGS. 1 to 7, a back portion of the seat 1 is provided with a left hinged plate 9 and a right hinged plate 10. A bottom left end and a bottom right end of the backrest 2 are hinged with the left hinged plate 9 and the right hinged plate 10, respectively. The left hinged plate 9 is provided with a plurality of adjacent and circularly arranged left receptacles 91. The right hinged plate 10 is provided with a plurality of adjacent and circularly arranged right receptacles 101. The backrest 2 is provided therein with a left inserting rod 11, a right inserting rod 12, and a pulling member that pulls the left inserting rod 11 and the right inserting rod 12 to move. A back end surface of the pulling member is provided with a pulling portion 13. A back end surface of the backrest 2 is provided with a hand placement groove 14. The pulling portion 13 is positioned in the hand placement groove 14.

Figure 3:
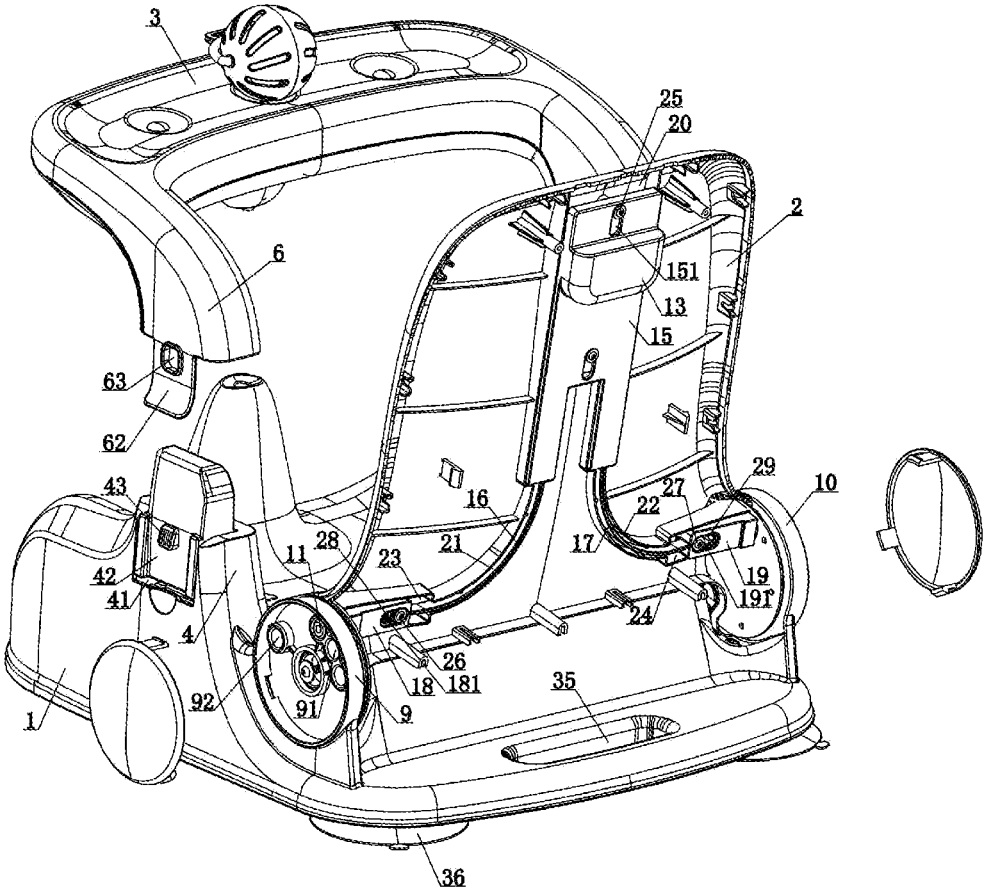
FIG. 3 is a structural exploded diagram of the present invention, wherein only an internal structure of a backrest is showed.
Figure 4:
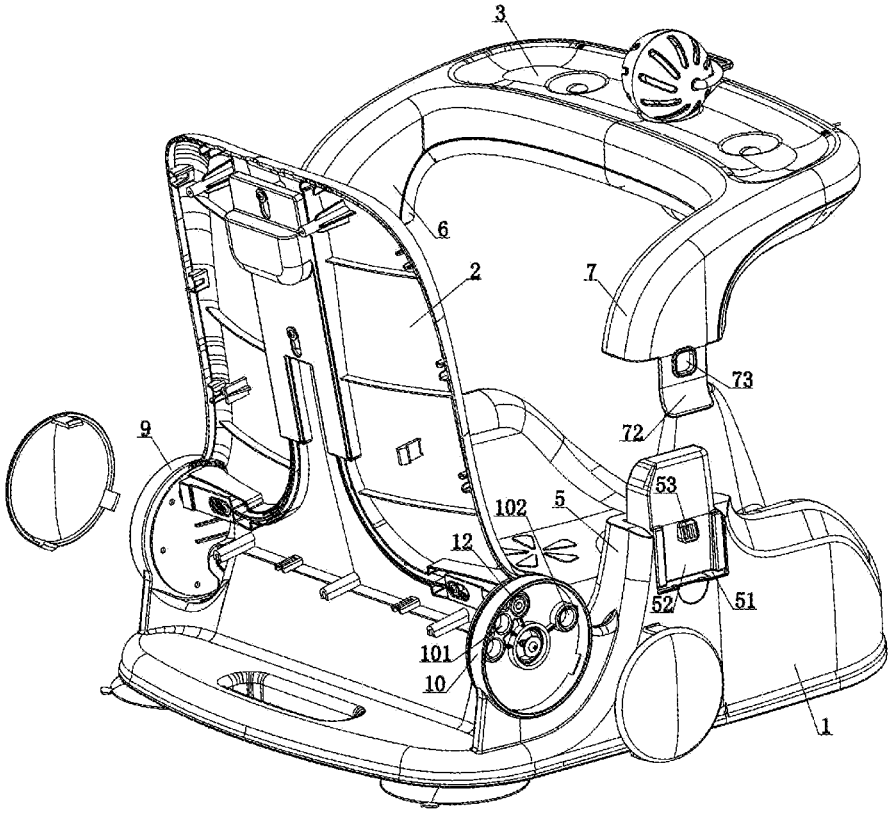
FIG. 4 is a structural diagram of FIG. 3 at another angle.

Referring to FIGS. 3 and 4, the pulling member includes a pulling plate 15, a left pulling rod 16, a right pulling rod 17, a left-inserting rod connecting portion 18, and a right-inserting rod connecting portion 19. A top end of the left pulling rod 16 and a top end of the right pulling rod 17 are connected to a bottom portion of the pulling plate 15. A bottom end of the left pulling rod 16 and a bottom end of the right pulling rod 17 are connected to a right end of the left-inserting rod connecting portion 18 and a left end of the right-inserting rod connecting portion 19, respectively. The left pulling rod 16 and the right pulling rod 17 are in a shape of Chinese character "Ba". A left end of the left-inserting rod connecting portion 18 is connected to a right end of the left-inserting rod 11. A right end of the right-inserting rod connecting portion 19 is connected to a left end of the right inserting rod 12. A left end of the left inserting rod 11 is inserted into the left receptacle 91 by passing through the bottom left end of the backrest 2. A right end of the right inserting rod 12 is inserted into the right receptacle 101 by passing through a bottom right end of the backrest 2. The pulling portion 13 is arranged at a back end surface of the pulling plate 15. When being moved toward a top portion of the backrest 2, the pulling plate 15 is moved toward a middle portion of the backrest 2 by pulling the left-inserting rod connecting portion 18 and the right-inserting rod connecting portion 19 via the left pulling rod 16 and the right pulling rod 17, and then drives the left inserting rod 11 and the right inserting rod 12 to pull out of the left receptacle 91 and the right receptacle 101, so that the backrest 2 can be rotated backwards and forwards relative to the seat 1 to adjust an angle of the backrest 2.

Referring to FIGS. 3 and 4, the backrest 2 is provided therein with a pulling plate groove 20, a left-pulling rod groove 21, a right-pulling rod groove 22, a left movable groove 23, and a right movable groove 24 that are mutually connected. The pulling plate 15 is positioned in the pulling plate groove 20. The pulling plate 15 has a height smaller than that of the pulling plate groove 20 so that the pulling plate 15 can be moved up and down in the pulling plate groove 20. The pulling plate 15 is provided with two strip-shaped grooves 151 arranged above and below. The pulling plate 15 is limited in the pulling plate groove 20 by passing through the two strip-shaped grooves 151 via two screws with gaskets 25, respectively, to improve movement stability of the pulling plate 15. The left pulling rod 16 and the right pulling rod 17 are positioned in the left-pulling rod groove 21 and the right-pulling rod groove 22, respectively. The left-inserting rod connecting portion 18 has a length less than that of the left movable groove 23. The right-inserting rod connecting portion 19 has a length less than that of the right movable groove 24. Therefore, the left-inserting rod connecting portion 18 and the right-inserting rod connecting portion 19 can be reciprocated in length directions of the left movable groove 23 and the right movable groove 24. The left-inserting rod connecting portion 18 and the right-inserting rod connecting portion 19 are provided with a left strip-shaped groove 181 and a right strip-shaped groove 191, respectively. The left-inserting rod connecting portion 18 is limited in the left movable groove 23 by passing through the left strip-shaped groove 181 via a left screw 26 with a gasket. The right-inserting rod connecting portion 19 is limited in the right movable groove 24 by passing through the right strip-shaped groove 191 via a right screw 27 with a gasket.

It needs to be explained that the left movable groove 23 and the right movable groove 24 are arranged to extend in a horizontal direction relative to the backrest 2 so that the left-inserting rod connecting portion 18 and the right-inserting rod connecting portion 19 drive the left pulling rod 16 and the right pulling rod 17 to move in the horizontal direction, which can effectively improve movement stability of the left pulling rod 16 and the right pulling rod 17.

The left-inserting rod connecting portion 18 is provided therein with a left spring 28 that abuts against the left screw 26. The right-inserting rod connecting portion 19 is provided with a right spring 29 that abuts against the right screw 27. It can be understood that one end of the left spring 28 abuts against the left screw 26, and the other end thereof abuts against an inner wall of the left-inserting rod connecting portion 18. One end of the right spring 29 abuts against the right screw 27, and the other end thereof abuts against an inner wall of the right-inserting rod connecting portion 19. Therefore, the pulling plate 15 pulls the left pulling rod 16 and the right pulling rod 17 out of the left receptacle 91 and the right receptacle 101. The left pulling rod 16 and the right pulling rod 17 can be automatically reset into the left receptacle 91 and the right receptacle 101 via the left spring 28 and the right springs 29, thus effectively improving practicality of the baby bath chair.

Referring to FIGS. 3 and 4, the left hinged plate 9 is provided with a left folding receptacle 92. The left folding receptacle 92 is positioned at a front side of the left receptacle 91 and can be inserted by the left inserting rod 11. The right hinged plate 10 is provided with a right folding receptacle 102. The right folding receptacle 102 is positioned at a front side of the right receptacle 101 and can be inserted by the right inserting rod 12. It needs to be explained that the front side of the left receptacle 91 or the front side of the right receptacle 101 is a side far away from the left receptacle 91 or a side far away from the right receptacle 101. When the left inserting rod 11 and the right inserting rod 12 are inserted into the left folding receptacle 92 and the right folding receptacle 102, respectively, the backrest 2 is in a folded state at this time, thereby reducing a transport space.

Referring to FIGS. 1 to 6, the left convex portion 4 and the right convex portion 5 are provided with a left hinged groove 41 and a right hinged groove 51, respectively. A left end surface of the left hinged groove 41 and a right end surface of the right hinged groove 51 are both open structures for providing rotational spaces for the left convex portion 4 and the right convex portion 5. The left hinged groove 41 is provided therein with a left hinged portion 42 hinged therewith. The right hinged groove 51 is provided therein with and a right hinged portion 52 hinged therewith. It needs to be explained that the left hinged portion 42 and the right hinged portion 52 are hinged with inner wall surfaces of the left hinged groove 41 and the right hinged groove 51. A bottom portion of the left connecting portion 6 and a bottom portion of the right connecting portion 7 are provided with a left slot 61 and a right slot 71, respectively. An upper portion of the left hinged portion 42 and an upper portion of the right hinged portion 52 are positioned in the left slot 61 and the right slot 71, respectively. A bottom left side of the left connecting portion 6 is provided with a resilient left side plate 62. The left side plate 62 is provided with a left sticking hole 63. A left side surface of the left hinged portion 42 is provided with a left sticking portion 43 that is clipped into the left sticking hole 63. A bottom right side of the right connecting portion 7 is provided with a resilient right side plate 72. The right side plate 72 is provided with a right sticking hole 73. A right side surface of the right hinged portion 52 is provided with a right sticking portion 53 that is clipped into the right sticking hole 73. Movable gaps are provided between a bottom surface of the left hinged portion 42 and an inner bottom surface of the left hinged groove 41, and between a bottom surface of the right hinged portion 52 and an inner bottom surface of the right hinged groove 51, to provide rotational spaces for the left convex portion 4 and the right convex portion 5.

Figure 5:
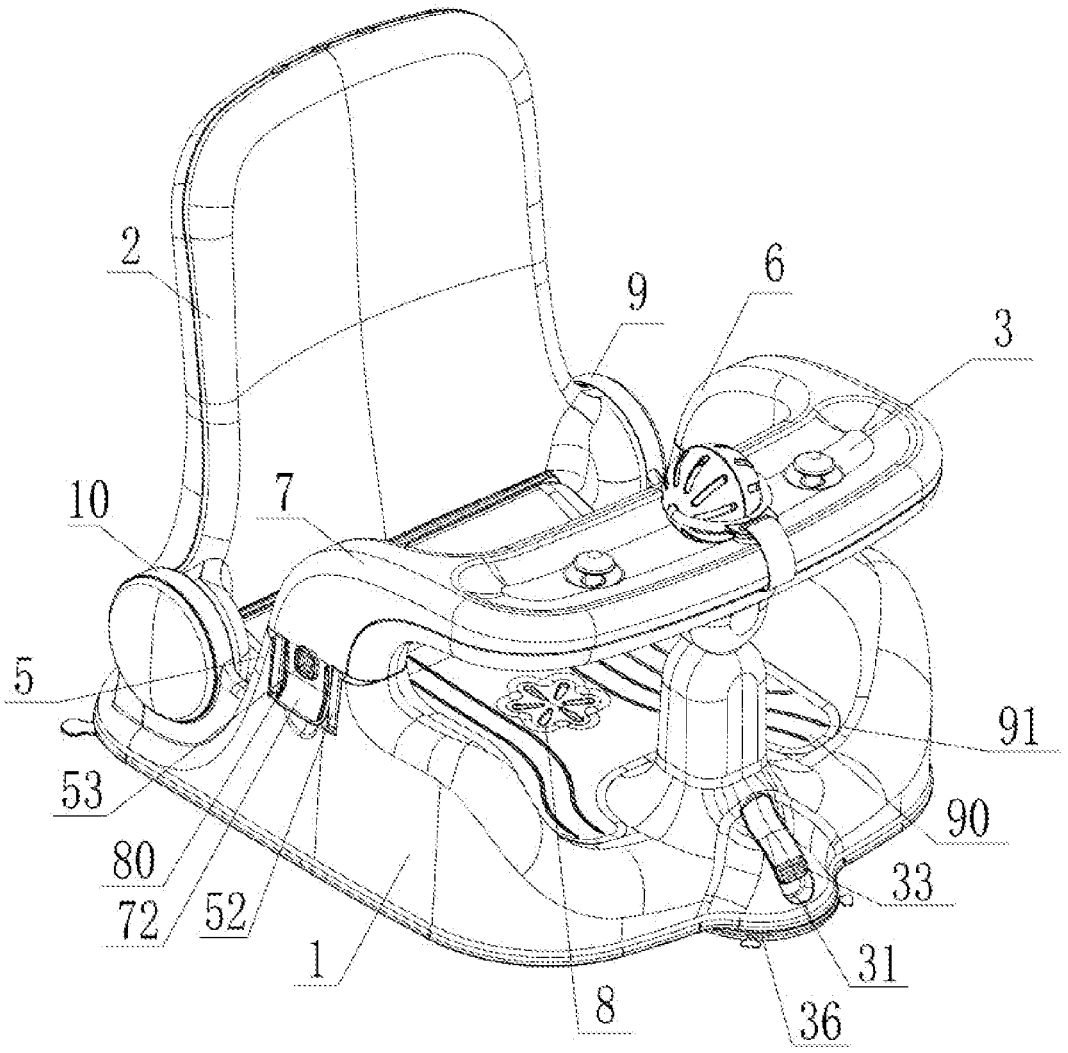
FIG. 5 is a schematic structural diagram of another embodiment of the present invention.
Figure 6:
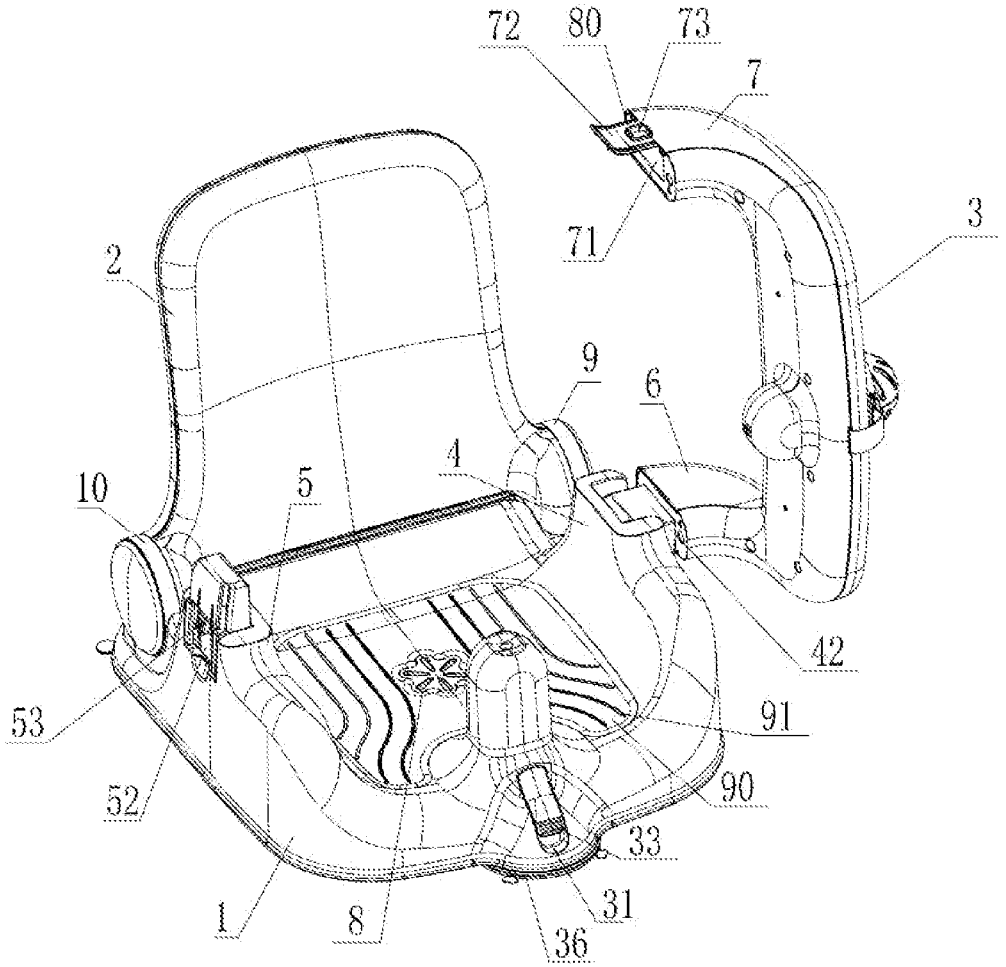
FIG. 6 is a schematic structural diagram of yet another embodiment of the present invention.
Figure 7:
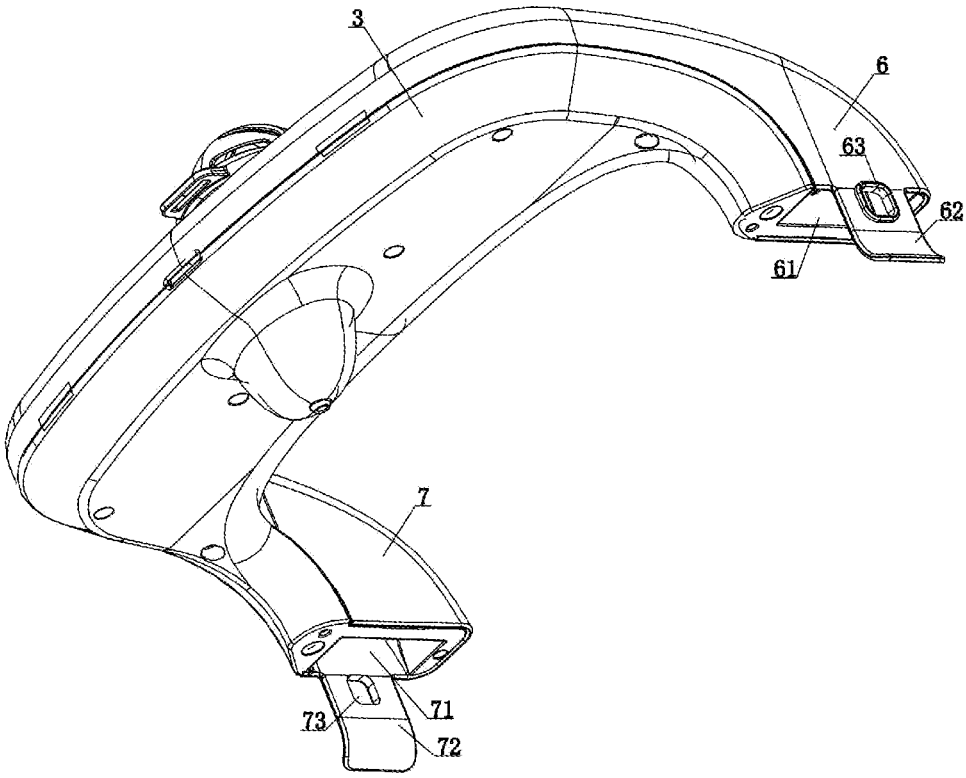
FIG. 7 is a schematic structural diagram of a dish tray of the present invention.
Figure 8:
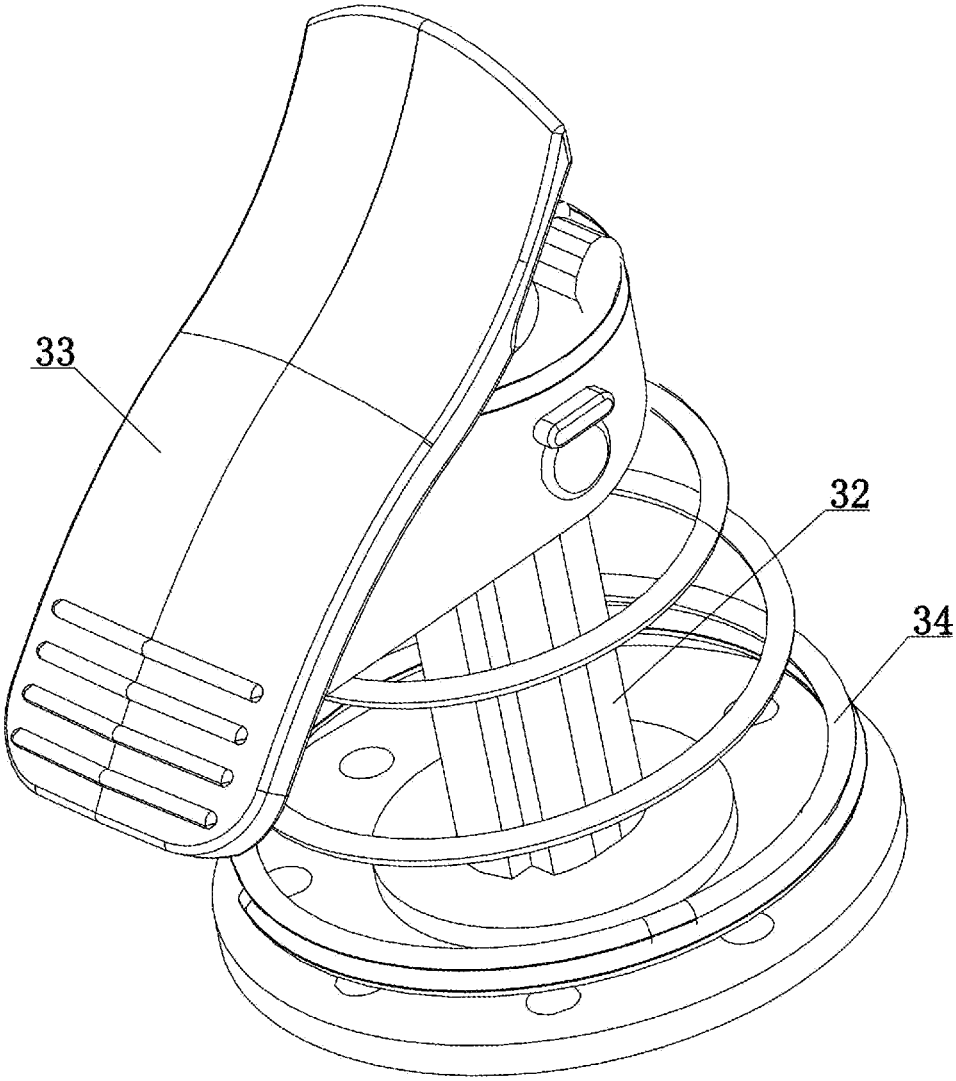
FIG. 8 is a structure diagram of connection of an unlocking button and a hinged rod of the present invention.

Referring to FIGS. 5 and 6, outer wall surfaces of the left side plate 62 and the right side plate 72 are provided with reinforcing ribs 80, thereby effectively preventing the left side plate 62 or the right side plate 72 from being fractured when the left side plate 62 or the right side plate 72 is pushed.

Referring to FIGS. 1 to 7, when the left side plate 62 or the right side plate 72 is pushed, the left sticking portion 43 or the right sticking portion 53 is separated from the left sticking hole 63 or the right sticking hole 73. At this time, the dish tray 3 can be rotated around the left convex portion 4 or the right convex portion 5 to facilitate a baby to enter the seat from a front side of the seat 1. When the baby enters the seat 1, the dish tray 3 is rotated and reset, and the left sticking portion 43 or the right sticking portion 53 is re-clipped into the left sticking hole 63 or the right sticking hole 73 to fix the dish tray 3.

Figure 2:
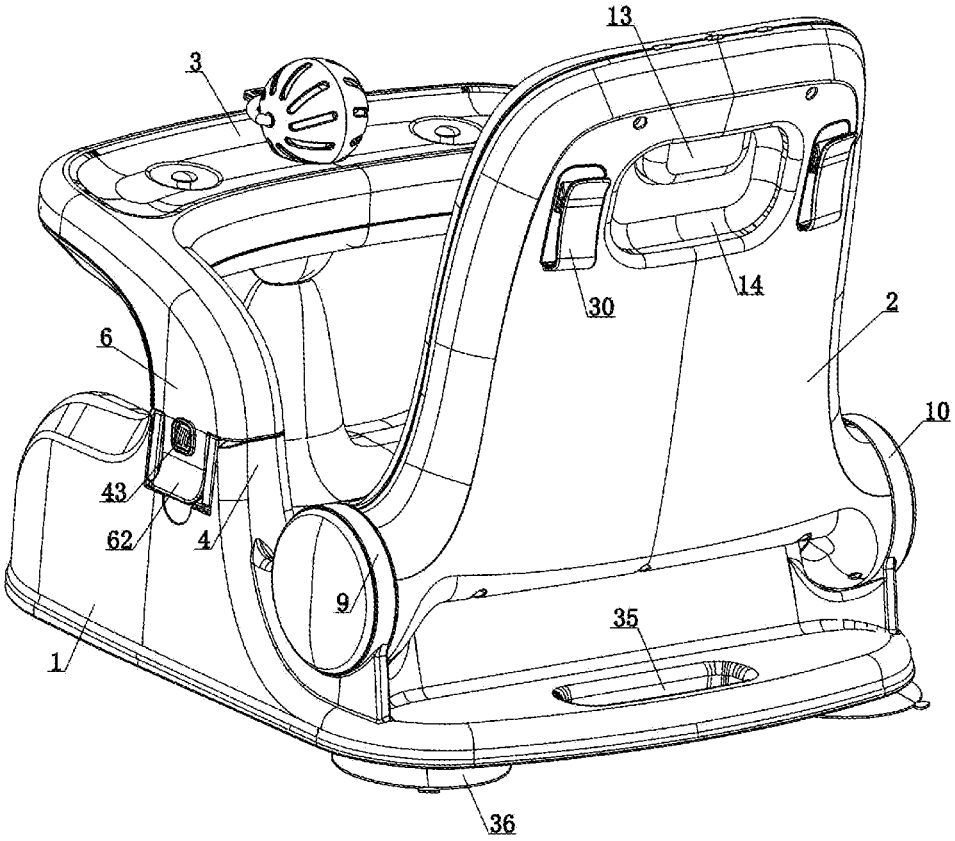
FIG. 2 is a schematic structural diagram of FIG. 1 at another angle.

Referring to FIG. 2, the back end surface of the backrest 2 is provided with two towel hooks 30 for hanging a towel.

Referring to FIGS. 1 to 8, the baby bath chair further includes a fixing assembly arranged at a front end of the seat 1. The fixing assembly includes a suction tray 36, a hinged rod 32, an unlocking handle 33, and a resetting spring 34. The front end of the seat 1 is provided with a fixing groove 31. A bottom portion of the fixing groove 31 is provided with a through hole. The hinged rod 32 is connected to the suction tray 36 by passing through the through hole. The unlocking handle 33 is arranged in the fixing groove 31 and hinged with the hinged rod 32. The resetting spring 34 is sleeved on the hinged rod 32, and two ends thereof abut against inner walls of the seat 1 and the suction tray 36, respectively. It can be understood that when the baby bath chair is fixed to the ground, vacuum is formed between the suction tray 36 and the ground, so that the baby bath chair can be fixed to the ground stably. When the unlocking handle 33 is pulled upwards, the suction tray 36 is squeezed downwards under an action of the resetting spring 34, thereby releasing vacuum adsorption between the suction tray 36 and the ground. A mother can then lift the bath chair off the ground. Similarly, when the bath chair needs to be fixed, the unlocking handle 33 is pressed downwards, and the hinged rod 32 pulls a middle portion of the suction tray 36 upwards, thereby forming the vacuum adsorption between the suction tray 36 and the ground, and fixing the bath chair on the ground.

In addition, the plurality of suction trays 36 may be provided at a bottom portion of the bath chair to improve stability of the bath chair fixed to the ground.

Referring to FIGS. 2 to 4, the back end of the seat is provided with a portable groove 35, which is also convenient for the mother to pull up the bath chair.

Referring to FIGS. 5 and 6, a slide-proof pad 90 is provided on a top surface of the seat. A plurality of slide-proof strips 91 are provided on the slide-proof pad 90 to enable the baby to sit stably in the bath chair.

The forgoing is only a preferable embodiment of the present invention, and is not intended to limit the patent scope of the present invention. Under the inventive concept of the present invention, an equivalent structure variation made by the contents of the specification and drawings of the present invention directly or indirectly applied to other related arts is included in the scope of patent protection of the present invention.

The invention claimed is:

1. A baby bath chair, comprising a seat, a backrest, and a dish tray, wherein the backrest is hinged with a back end of the seat, the backrest can be adjustably rotated in multiple stages forwards and rearwards, a left-side middle portion and a right-side middle portion of the seat are formed with a left convex portion and a right convex portion, respectively, a back end of the dish tray is formed with a left connecting portion and a right connecting portion, the left connecting portion and the right connecting portion are detachably connected to the left convex portion and the right convex portion, respectively, the left connecting portion and the right connecting portion can be rotated around the left convex portion and the right convex portion, respectively, and a top surface of the seat is provided with a drainage hole.

2. The baby bath chair according to claim 1, wherein a back portion of the seat is provided with a left hinged plate and a right hinged plate, a bottom left end and a bottom right end of the backrest are hinged with the left hinged plate and the right hinged plate, respectively, the left hinged plate is provided with a plurality of adjacent and circularly arranged left receptacles, the right hinged plate is provided with a plurality of adjacent and circularly arranged right receptacles, the backrest is provided therein with a left inserting rod and a right inserting rod, and a pulling member that pulls the left inserting rod and the right inserting rod to move, a back end surface of the pulling member is provided with a pulling portion, a back end surface of the backrest is provided with a hand placement groove, and the pulling portion is positioned in the hand placement groove.

3. The baby bath chair according to claim 2, wherein the pulling member comprises a pulling plate, a left pulling rod, a right pulling rod, a left-inserting rod connecting portion, and a right-inserting rod connecting portion, a top end of the left pulling rod and a top end of the right pulling rod are connected to a bottom portion of the pulling plate, a bottom end of the left pulling rod, and a bottom end of the right pulling rod are connected to a right end of the left-inserting rod connecting portion and a left end of the right-inserting rod connecting portion, respectively, the left pulling rod and the right pulling rod are arranged in a shape of Chinese character "Ba" at a back portion of the seat, a left end of the left-inserting rod connecting portion is connected to a right end of the left inserting rod, a right end of the right-inserting rod connecting portion is connected to a left end of the right inserting rod, a left end of the left inserting rod is inserted into the left receptacle by passing through the bottom left end of the backrest, a right end of the right inserting rod is inserted into the right receptacle by passing through a bottom right end of the backrest, and the pulling portion is arranged on a back end surface of the pulling plate.

4. The baby bath chair according to claim 3, wherein the backrest is provided therein with a pulling plate groove, a left-pulling rod groove, a right-pulling rod groove, a left movable groove, and a right movable groove that are mutually connected, the pulling plate is positioned in the pulling plate groove, the pulling plate has a height smaller than that of the pulling plate groove, the pulling plate is provided with two strip-shaped grooves arranged above and below, the pulling plate is limited in the pulling plate groove by passing through the two strip-shaped grooves via two screws with gaskets, the left pulling rod and the right pulling rod are positioned in the left-pulling rod groove and the right-pulling rod groove, respectively, the left-inserting rod connecting portion and the right-inserting rod connecting portion are positioned in the left movable groove and the right movable groove, respectively, the left-inserting rod connection portion has a length smaller than that of the left movable groove, the right-inserting rod connection portion has a length smaller than that of the right movable groove, the left-inserting rod connecting portion and the right-inserting connecting portion are provided with a left strip-shaped groove and a right strip-shaped groove, the left-inserting rod connecting portion is limited in the left movable groove by passing through the left strip-shaped groove via a left screw with a gasket, the right-inserting rod connecting portion is limited in the right movable groove by passing through the right strip-shaped groove via a right screw with a gasket, the left-inserting rod connecting portion is provided therein with a left spring that abuts against the left screw, and the right-inserting rod connecting portion is provided therein with a right spring that abuts against the right screw.

5. The baby bath chair according to claim 2, wherein the left hinged plate is provided with a left folding receptacle, the left folding receptacle is positioned at a front side of the left receptacle and can be inserted by the left inserting rod, the right hinged plate is provided with a right folding receptacle, the right folding receptacle is positioned on a front side of the right receptacle and can be inserted by the right inserting rod.

6. The baby bath chair according to claim 1, wherein the left convex portion and the right convex portion are provided with a left hinged groove and a right hinged groove, respectively, a left end surface of the left hinged groove and a right end surface of the right hinged groove are both open structures, the left hinged groove is provided with a left hinged portion hinged therewith, the right hinged groove is provided with a right hinged portion hinged therewith, a bottom portion of the left connecting portion is provided with a left slot, a bottom portion of the right connecting portion is provided with a right slot, an upper portion of the left hinged portion is positioned in the left slot, an upper portion of the right hinged portion is positioned in the right slot, a bottom left side of the left connecting portion is provided with a resilient left side plate, the left side plate is provided with a left sticking hole, a left side surface of the left hinged portion is provided with a left sticking portion that is clipped into the left sticking hole, a bottom right side of the right connecting portion is provided with a resilient right side plate, the right side plate is provided with a right sticking hole, a right side surface of the right hinged portion is provided with a right sticking portion that is clipped into the right sticking hole, movable gaps are provided between a bottom surface of the left hinged portion and an inner bottom surface of the left hinged groove, and between a bottom surface of the right hinged portion and an inner bottom surface of the right hinged groove.

7. The baby bath chair according to claim 6, wherein the outer wall surfaces of the left side plate and the right side plate are provided with reinforcing ribs.

8. The baby bath chair according to claim 1, wherein the back end surface of the backrest is provided with two towel hooks.

9. The baby bath chair according to claim 1, wherein the baby bath chair further comprises a fixing assembly arranged at the front end of the seat, the fixing assembly comprises a suction tray, a hinged rod, an unlocking handle, and a resetting spring, the front end of the seat is provided with a fixing groove, a bottom portion of the fixing groove is opened and provided with a through hole, the hinged rod is connected to the suction tray by passing through the through hole, the unlocking handle is arranged in the fixing groove and hinged with the hinged rod, the resetting spring is sleeved on the hinged rod, and two ends thereof abut against the suction tray and an interior wall of the seat, respectively.

10. The baby bath chair according to claim 1, wherein the back end of the seat is provided with a portable groove.

11. The baby bath chair according to claim 1, wherein a bottom portion of the seat is provided with the plurality of suction trays.

12. The baby bath chair according to claim 1, wherein the top surface of the seat is provided with a slide-proof pad, and a plurality of slide-proof strips are provided on the slide-proof pad.

* * * * *